US005288819A

United States Patent [19]

Magid et al.

[11] Patent Number: 5,288,819

[45] Date of Patent: * Feb. 22, 1994

[54] AZEOTROPE-LIKE COMPOSITIONS OF DICHLOROPENTAFLUOROPROPANE AND 1,2-DICHLOROETHYLENE

[75] Inventors: Hillel Magid, Buffalo; Richard E. Eibeck, Orchard Park; Michael Van Der Puy, Cheektowaga; Richard M. Hollister, Buffalo; Dennis M. Lavery, Springville; David P. Wilson, East Amherst, all of N.Y.

[73] Assignee: AlliedSignal Inc., Morris Township, Morris County, N.J.

[ * ] Notice: The portion of the term of this patent subsequent to May 26, 2009 has been disclaimed.

[21] Appl. No.: 842,849

[22] Filed: Feb. 24, 1992

Related U.S. Application Data

[63] Continuation of Ser. No. 549,781, Jul. 9, 1990, Pat. No. 5,116,526, which is a continuation-in-part of Ser. No. 418,317, Oct. 6, 1989, abandoned, and a continuation-in-part of Ser. No. 417,952, Oct. 6, 1989, abandoned.

[51] Int. Cl.[5] ..... C11D 7/30; C11D 7/50; C23G 5/028

[52] U.S. Cl. ..... 252/172; 134/12; 134/31; 134/38; 134/40; 252/153; 252/162; 252/364; 252/DIG. 9

[58] Field of Search ..... 252/153, 162, 172, 364, 252/DIG. 9; 134/12, 31, 38, 39, 40

[56] References Cited

U.S. PATENT DOCUMENTS

| | | | |
|---|---|---|---|
| 4,465,609 | 8/1984 | Denis et al. | 252/67 |
| 4,947,881 | 8/1990 | Magid et al. | 134/40 |
| 4,961,869 | 10/1990 | Eggers et al. | 252/170 |
| 5,102,563 | 4/1992 | Desbiendras et al. | 252/171 |
| 5,104,565 | 4/1992 | Magid et al. | 252/171 |
| 5,106,526 | 4/1992 | Magid et al. | 252/171 |
| 5,116,426 | 5/1992 | Asano et al. | 252/171 |
| 5,116,525 | 5/1992 | Merchant | 252/171 |
| 5,116,526 | 5/1992 | Magid et al. | 252/172 |
| 5,118,437 | 6/1992 | Magid et al. | 252/171 |
| 5,118,438 | 6/1992 | Magid et al. | 252/172 |
| 5,120,462 | 6/1992 | Buchwald et al. | 252/171 |
| 5,124,065 | 6/1992 | Magid et al. | 252/171 |
| 5,135,676 | 8/1992 | Buchwald et al. | 252/171 |

FOREIGN PATENT DOCUMENTS

| | | | |
|---|---|---|---|
| 347924 | 12/1989 | European Pat. Off. . | |
| 450854 | 10/1991 | European Pat. Off. . | |
| 450856 | 10/1991 | European Pat. Off. . | |
| 2-120335 | 5/1990 | Japan . | |
| 2-207032 | 8/1990 | Japan | 252/67 |
| 2-207033 | 8/1990 | Japan | 252/172 |
| 2-237947 | 9/1990 | Japan . | |
| 1562026 | 3/1980 | United Kingdom . | |
| 90/08814 | 8/1990 | World Int. Prop. O. . | |
| 90/08815 | 8/1990 | World Int. Prop. O. . | |

OTHER PUBLICATIONS

Asahi Glass Company New Release Feb. 6, 1989 pp. 1-5.

*Primary Examiner*—Linda Skaling

*Attorney, Agent, or Firm*—Colleen D. Szuch; Jay P. Friedenson

[57] ABSTRACT

Azeotrope-like compositions comprising dichloropentafluoropropane and 1,2-dichloroethylene are stable and have utility as degreasing agents and as solvents in a variety of industrial cleaning applications including cold cleaning and defluxing of printed circuit boards.

42 Claims, No Drawings

AZEOTROPE-LIKE COMPOSITIONS OF DICHLOROPENTAFLUOROPROPANE AND 1,2-DICHLOROETHYLENE

This is a continuation of co-pending application Ser. No. 549,781, filed Jul. 9, 1990, now U.S. Pat. No. 5,116,526 which is a continuation-in-part of U.S. patent application Ser. No. 418,317 filed Oct. 6, 1989, now abandoned; and U.S. patent application Ser. No. 417,952 filed Oct. 6, 1989, now abandoned.

FIELD OF THE INVENTION

This invention relates to azeotrope-like or essentially constant-boiling mixtures of dichloropentafluoropropane and 1,2-dichloroethylene. These mixtures are useful in a variety of vapor degreasing, cold cleaning and solvent cleaning applications including defluxing and dry cleaning.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications, the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions including the desired fluorocarbon components such as trichlorotrifluoroethane which include components which contribute additionally desired characteristics, such as polar functionality, increased solvency power, and stabilizers. Azeotropic compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant-boiling point, i.e., is an azeotrope or is azeotrope-like, fractionation will occur and undesirable solvent distribution may act to upset the cleaning and safety of processing. Preferential evaporation of the more volatile components of the solvent mixtures, which would be the case if they were not an azeotrope or azeotrope-like, would result in mixtures with changed compositions which may have less desirable properties, such as lower solvency towards soils, less inertness towards metal, plastic or elastomer components, and increased flammability and toxicity.

The art is continually seeking new fluorocarbon based azeotropic mixtures or azeotrope-like mixtures which offer alternatives for new and special applications for vapor degreasing and other cleaning applications. Currently, of particular interest, are such azeotrope-like mixtures which are based on fluorocarbons which are considered to be stratospherically safe substitutes for presently used fully halogenated chlorofluorocarbons. The latter are suspected of causing environmental problems in connection with the earth's protective ozone layer. Mathematical models have substantiated that hydrochlorofluorocarbons, such as 1,1-dichloro-2,2,3,3,3-pentafluoropropane (HCFC-225ca) and 1,3-dichloro-1,1,2,2,3-pentafluoropropane (HCFC-225cb), will not adversely affect atmospheric chemistry, being negligible contributors to ozone depletion and to green-house global warming in comparison to the fully halogenated species.

In our search for new fluorocarbon based azeotropic or azeotrope-like mixtures, we have unexpectedly discovered 1,1-dichloro-2,2,3,3,3-pentafluoropropane and 1,3-dichloro-1,1,2,2,3-pentafluoropropane based azeotropes.

It is an object of this invention to provide novel azeotrope-like compositions based on HCFC-225ca or HCFC-225cb and 1,2-dichloroethylene which are liquid at room temperature, which will not fractionate under the process of distillation or evaporation, and which are useful as solvents for use in vapor degreasing and other solvent cleaning applications including defluxing applications.

Another object of the invention is to provide novel environmentally acceptable solvents for use in the aforementioned applications.

Other objects and advantages of the invention will become apparent from the following description.

SUMMARY OF THE INVENTION

The invention relates to novel azeotrope-like compositions which are useful in a variety of industrial cleaning applications. Specifically, the invention relates to compositions of dichloropentafluoropropane and 1,2-dichloroethylene which are essentially constant-boiling, environmentally acceptable, and which remain liquid at room temperature.

DESCRIPTION OF THE INVENTION

In accordance with the invention, novel azeotrope-like compositions have been discovered comprising dichloropentafluoropropane and 1,2-dichloroethylene. The 1,2-dichloroethylene component may be cis-1,2-dichloroethylene; trans-1,2-dichloroethylene; and mixtures thereof in any proportions.

Preferably, the novel azeotrope-like compositions comprise effective amounts of dichloropentafluoropropane and 1,2-dichloroethylene. The term "effective amounts" as used herein means the amount of each component which upon combination with the other component, results in the formation of the present azeotrope-like composition.

Dichloropentafluoropropane exists in nine isomeric forms:

(1) 2,2-dichloro-1,1,1,3,3-pentafluoropropane(HCFC-225a);
(2) 1,2-dichloro-1,2,3,3,3-pentafluoropropane(HCFC-225ba);
(3) 1,2-dichloro-1,1,2,3,3-pentafluoropropane(HCFC-225bb);
(4) 1,1-dichloro-2,2,3,3,3-pentafluoropropane(HCFC-225ca);
(5) 1,3-dichloro-1,1,2,2,3-pentafluoropropane(HCFC-225cb);
(6) 1,1-dichloro-1,2,2,3,3-pentafluoropropane(HCFC-225cc);
(7) 1,2-dichloro-1,1,3,3,3-pentafluoropropane(HCFC-225d);
(8) 1,3-dichloro-1,1,2,3,3-pentafluoropropane(HCFC-225ea); and
(9) 1,1-dichloro-1,2,3,3,3-pentafluoropropane(HCFC-225eb).

For purposes of this invention, dichloropentafluoropropane will refer to any of the isomers or an admixture of the isomers in any proportion. The 1,1-dichloro-2,2,3,3,3-pentafluoropropane and 1,3-dichloro-1,1,2,2,3-pentafluoropropane isomers, however, are the preferred isomers. When mixtures of isomers are used, a mixture of 1,1-dichloro-2,2,3,3,3-pentafluoropropane and 1,3-dichloro-1,1,2,2,3-pentafluoropropane is especially preferred.

The dichloropentafluoropropane component of the invention has good solvent properties. The 1,2-dichloroethylene component also has good solvent properties and enhances the solubilities of oils. Thus, when these components are combined in effective amounts, an efficient azeotropic solvent results.

When the 1,2-dichloroethylene is cis-1,2-dichloroethylene, the novel azeotrope-like compositions comprise dichloropentafluoropropane and cis-1,2-dichloroethylene which boil at about 52.0° C. ± about 2.5° C. at 760 mm Hg (101 kPa)

Preferably, when the 1,2-dichloroethylene is cis-1,2-dichloroethylene, the azeotrope-like compositions of the invention comprise from about 62 to about 93 weight percent dichloropentafluoropropane and from about 7 to about 38 weight percent cis-1,2-dichloroethylene wherein the azeotrope-like components consist of the dichloropentafluoropropane and the cis-1,2-dichloroethylene and the azeotrope-like compositions boil at about 52.0° C. ± about 2.5° C. at 760 mm Hg (101 kPa), and preferably at about 52.0° C. ± about 1.8° C. at 760 mm Hg (101 kPa).

More preferably, the azeotrope-like compositions of the invention comprise from about 66 to about 91 weight percent dichloropentafluoropropane and from about 9 to about 34 weight percent cis-1,2-dichloroethylene.

When the 1,2-dichloroethylene is cis-1,2-dichloroethylene and the dichloropentafluoropropane is 1,1-dichloro-2,2,3,3,3-pentafluoropropane, the novel azeotrope-like compositions comprise 1,1-dichloro-2,2,3,3,3-pentafluoropropane and cis-1,2-dichloroethylene which boil at about 50.0° C. ± about 0.5° C., and preferably ± about 0.3° C., at 753 mm Hg (100 kPa).

Preferably, the novel azeotrope-like compositions of the invention comprise from about 77 to about 93 weight percent 1,1-dichloro-2,2,3,3,3-pentafluoropropane and from about 7 to about 23 weight percent cis-1,2-dichloroethylene which boil at about 50.0° C. at 753 mm Hg (100 kPa).

In a more preferred embodiment of the invention, the azeotrope-like compositions of the invention comprise from about 80 to about 92 weight percent 1,1-dichloro-2,2,3,3,3-pentafluoropropane and from about 8 to about 20 weight percent cis-1,2-dichloroethylene.

In a most preferred embodiment of the invention, the azeotrope-like compositions of the invention comprise from about 80 to about 91 weight percent 1,1-dichloro-2,2,3,3,3-pentafluoropropane and from about 9 to about 20 weight percent cis-1,2-dichloroethylene.

When the 1,2-dichloroethylene is cis-1,2-dichloroethylene and the dichloropentafluoropropane is 1,3-dichloro-1,1,2,2,3-pentafluoropropane, novel azeotrope-like compositions comprise 1,3-dichloro-1,1,2,2,3-pentafluoropropane and cis-1,2-dichloroethylene which boil at about 53.5° C. ± about 0.5° C., and preferably ± about 0.3° C., at 751 mm Hg (100 kPa).

Preferably, the novel azeotrope-like compositions comprise from about 62 to about 82 weight percent 1,3-dichloro-1,1,2,2,3-pentafluoropropane and from about 18 to about 38 weight percent cis-1,2-dichloroethylene which boil at about 53.5° C. at 751 mm Hg (100 kPa).

In a more preferred embodiment of the invention, the azeotrope-like compositions of the invention comprise from about 64 to about 80 weight percent 1,3-dichloro-1,1,2,2,3-pentafluoropropane and from about 20 to about 36 weight percent cis-1,2-dichloroethylene.

In the most preferred embodiment of the invention, the azeotrope-like compositions of the invention comprise from about 66 to about 80 weight percent 1,3-dichloro-1,1,2,2,3-pentafluoropropane and from about 20 to about 34 weight percent cis-1,2-dichloroethylene.

When the 1,2-dichloroethylene is cis-1,2-dichloroethylene, the azeotrope-like compositions of the invention comprise from about 62 to about 93 weight percent of a mixture of 1,1-dichloro-2,2,3,3,3-pentafluoropropane and 1,3-dichloro-1,1,2,2,3-pentafluoropropane; and from about 7 to about 38 weight percent cis-1,2-dichloroethylene which boil at about 52.0° C. ± about 2.5° C. at 760 mm Hg (101 kPa), and more preferably at about 52.0° C. ± about 1.8° C. at 760 mm Hg (101 kPa).

Preferably, the azeotrope-like compositions of the invention comprise from about 66 to about 91 weight percent of a mixture of 1,1-dichloro-2,2,3,3,3-pentafluoropropane and 1,3-dichloro-1,1,2,2,3-pentafluoropropane; and from about 9 to about 34 weight percent cis-1,2-dichloroethylene.

When the 1,2-dichloroethylene is trans-1,2-dichloroethylene, the novel azeotrope-like compositions comprise dichloropentafluoropropane and trans-1,2-dichloroethylene which boil at about 45.5° C. ± about 2.0° C. at 760 mm Hg (101 kPa), and preferably at about 45.5° C. ± about 1.5° C. at 760 mm Hg (101 kPa).

Preferably, when the 1,2-dichloroethylene is trans-1,2-dichloroethylene, the azeotrope-like compositions of the invention comprise from about 23 to about 60 weight percent dichloropentafluoropropane and from about 40 to about 77 weight percent trans-1,2-dichloroethylene wherein the azeotrope-like components consist of the dichloropentafluoropropane and the trans-1,2-dichloroethylene and the azeotrope-like compositions boil at about 45.5° C. ± about 2.0° C. at 760 mm Hg (101 kPa), and preferably at about 45.5° C. ± about 1.2° C. at 760 mm Hg (101 kPa).

More preferably, the azeotrope-like compositions of the invention comprise from about 25 to about 56 weight percent dichloropentafluoropropane and from about 44 to about 75 weight percent trans-1,2-dichloroethylene.

When the 1,2-dichloroethylene is trans-1,2-dichloroethylene and the dichloropentafluoropropane is 1,1-dichloro-2,2,3,3,3-pentafluoropropane, the novel azeotrope-like compositions comprise 1,1-dichloro-2,2,3,3,3-pentafluoropropane and trans-1,2-dichloroethylene which boil at about 44.2° C. ± about 0.5° C., and preferably ± about 0.3° C., at 745 mm Hg (100 kPa).

Preferably, the novel azeotrope-like compositions of the invention comprise from about 35 to about 60 weight percent 1,1-dichloro-2,2,3,3,3-pentafluoropropane and from about 40 to about 65 weight percent trans-1,2-dichloroethylene which boil at about 44.2° C. at 745 mm Hg (100 kPa).

In a most preferred embodiment of the invention, the azeotrope-like compositions of the invention comprise from about 38 to about 56 weight percent 1,1-dichloro-2,2,3,3,3-pentafluoropropane and from about 44 to about 62 weight percent trans-1,2-dichloroethylene.

When the 1,2-dichloroethylene is trans-1,2-dichloroethylene and the dichloropentafluoropropane is 1,3-dichloro-1,1,2,2,3-pentafluoropropane, novel azeotrope-like compositions comprise 1,3-dichloro-1,1,2,2,3-pentafluoropropane and trans-1,2-dichloroethylene which boil at about 45.5° C. ± about 0.5° C., and preferably ± about 0.3° C., at 743 mm Hg (99 kPa).

Preferably, the novel azeotrope-like compositions comprise from about 23 to about 49 weight percent 1,3-dichloro-1,1,2,2,3-pentafluoropropane and from about 51 to about 77 weight percent trans-1,2-dichloroethylene which boil at about 45.5° C. at 743 mm Hg (99 kPa).

In the most preferred embodiment of the invention, the azeotrope-like compositions of the invention comprise from about 25 to about 44 weight percent 1,3-dichloro-1,1,2,2,3-pentafluoropropane and from about 56 to about 75 weight percent trans-1,2-dichloroethylene.

When the 1,2-dichloroethylene is trans-1,2-dichloroethylene, the azeotrope-like compositions of the invention comprise from about 23 to about 60 weight percent of a mixture of 1,1-dichloro-2,2,3,3,3-pentafluoropropane and 1,3-dichloro-1,1,2,2,3-pentafluoropropane; and from about 40 to about 77 weight percent trans-1,2-dichloroethylene which boil at about 45.5° C. ± about 2.0° C. at 760 mm Hg (101 kPa), and more preferably at about 45.5° C. ± about 1.2° C. at 760 mm Hg (101 kPa).

The precise or true azeotrope compositions have not been determined but have been ascertained to be within the indicated ranges. Regardless of where the true azeotropes lie, all compositions within the indicated ranges, as well as certain compositions outside the indicated ranges, are azeotrope-like, as defined more particularly below.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at the stated P and T. In practice, this means that the components of a mixture cannot be separated during distillation, and therefore are useful in vapor phase solvent cleaning as described above.

For the purpose of this discussion, by azeotrope-like composition is intended to mean that the composition behaves like a true azeotrope in terms of its constant-boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Thus, one way to determine whether a candidate mixture is "azeotrope-like" within the meaning of this invention, is to distill a sample thereof under conditions (i.e. resolution—number of plates) which would be expected to separate the mixture into its separate components. If the mixture is non-azeotropic or non-azeotrope-like, the mixture will fractionate, i.e. separate into its various components with the lowest boiling component distilling off first, and so on. If the mixture is azeotrope-like, some finite amount of a first distillation cut will be obtained which contains all of the mixture components and which is constant-boiling or behaves as a single substance. This phenomenon cannot occur if the mixture is not azeotrope-like, i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like. All such compositions are intended to be covered by the term azeotrope-like as used herein. As an example, it is well known that at differing pressures, the composition of a given azeotrope will vary at least slightly as does the boiling point of the composition. Thus, an azeotrope of A and B represents a unique type of relationship but with a variable composition depending on temperature and/or pressure.

With HCFC-225ca and cis-1,2-dichloroethylene, the preferred mixtures boil within about ±0.3° C. (at about 753 mm Hg (100 kPa)) of the 50.0° C. boiling point. With HCFC-225ca and trans-1,2-dichloroethylene, the preferred mixtures boil within about ±0.3° C. (at about 745 mm Hg (100 kPa)) of the 44.2° C. boiling point. With HCFC-225cb and cis-1,2-dichloroethylene, the preferred mixtures boil within ± about 0.3° C. (at about 751 mm Hg (100 kPa)) of the 53.5° C. boiling point. With HCFC-225cb and trans-1,2-dichloroethylene, the preferred mixtures boil within ± about 0.3° C. (at about 743 mm Hg (99 kPa)) of the 45.5° C. boiling point. With mixtures of HCFC-225ca and HCFC-225cb, and cis-1,2-dichloroethylene, the preferred mixtures boil within ± about 2.5° C. (at about 760 mm Hg (101 kPa)) of the 52.0° C. boiling point. With mixtures of HCFC-225ca and HCFC-225cb, and trans-1,2-dichloroethylene, the preferred mixtures boil within ± about 2.0° C. (at about 760 mm Hg (101 kPa)) of the 45.5° C. boiling point. As is readily understood by persons skilled in the art, the boiling point of the azeotrope will vary with the pressure.

In the process embodiment of the invention, the azeotrope-like compositions of the invention may be used to clean solid surfaces by treating said surfaces with said compositions in any manner well known to the art such as by dipping or spraying or use of conventional degreasing apparatus.

It should be noted that HCFC-225ca alone or HCFC-225cb alone is useful as a solvent. The present azeotrope-like compositions are useful as solvents for use in vapor degreasing and other solvent cleaning applications including defluxing, cold cleaning, dry cleaning, dewatering, decontamination, spot cleaning, aerosol propelled rework, extraction, particle removal, and surfactant cleaning applications. These azeotrope-like compositions are also useful as blowing agents, rankine cycle and absorption refrigerants, and power fluids.

The HCFC-225ca; HCFC-225cb; cis-1,2-dichloroethylene; and trans-1,2-dichloroethylene components of the novel solvent azeotrope-like compositions of the invention are known materials. Commercially available cis-1,2-dichloroethylene and trans-1,2-dichloroethylene may be used in the present invention. It should be noted that commercially available cis-1,2-dichloroethylene may also contain trans-1,2-dichloroethylene; also, commercially available trans-1,2-dichloroethylene may also contain cis-1,2-dichloroethylene.

For example, cis-1,2-dichloroethylene may consist of a mixture of cis-1,2-dichloroethylene together with trans-1,2-dichloroethylene wherein trans-1,2-dichloroethylene is present in the mixture in an amount from about 0.1 to about 25 weight percent. Trans-1,2-dichloroethylene may also be present in the mixture in an amount from about 0.1 to about 10 weight percent. Trans-1,2-dichloroethylene may also be present in the mixture in an amount from about 0.1 to about 5 weight percent.

Also, for example, trans-1,2-dichloroethylene may consist of a mixture of trans-1,2-dichloroethylene together with cis-1,2-dichloroethylene wherein cis-1,2-dichloroethylene is present in the mixture in an amount from about 0.1 to about 25 weight percent. Cis-1,2-dichloroethylene may also be present in the mixture in an amount from about 0.1 to about 10 weight percent. Cis-1,2-dichloroethylene may also be present in the mixture in an amount from about 0.1 to about 5 weight percent.

Until HCFC-225ca becomes available in commercial quantities, HCFC-225ca may be prepared by a standard and well-known organic synthesis technique. For example, to prepare 1,1-dichloro-2,2,3,3,3-pentafluoropropane, 2,2,3,3,3-pentafluoro-1-propanol and p-toluenesulfonate chloride are reacted together to form 2,2,3,3,3-pentafluoropropyl-p-toluenesulfonate. Then, N-methylpyrrolidone, lithium chloride, and the 2,2,3,3,3-pentafluoropropyl-p-toluenesulfonate are reacted together to form 1-chloro-2,2,3,3,3-pentafluoropropane. Chlorine and the 1-chloro-2,2,3,3,3-pentafluoropropane are then reacted together to form 1,1-dichloro-2,2,3,3,3-pentafluoropropane. A detailed synthesis is set forth below.

Until HCFC-225cb becomes available in commercial quantities, HCFC-225cb may be prepared by a standard and well-known organic synthesis technique. For example, to prepare 1,3-dichloro-1,1,2,2,3-pentafluoropropane, 2,2,3,3-tetrafluoropropanol, tosyl chloride, and water are reacted together to form 2,2,3,3-tetrafluoropropyl p-toluenesulfonate. Then, N-methylpyrrolidone, potassium fluoride, and the 2,2,3,3-tetrafluoropropyl p-toluenesulfonate are reacted together to form 1,1,2,2,3-pentafluoropropane. Then, chlorine and the 1,1,2,2,3-pentafluoropropane are reacted to form 1,1,3-trichloro-1,2,2,3,2-pentafluoropropane. Finally, isopropanol and the 1,1,3-trichloro-1,2,2,3,2-pentafluoropropane are reacted to form 1,3-dichloro-1,1,2,2,3-pentafluoropropane. A detailed synthesis is set forth below.

Until HCFC-225a becomes available in commercial quantities, HCFC-225a may be prepared by a standard and well-known organic synthesis technique. For example, 2,2-dichloro-1,1,1,3,3-pentafluoropropane may be prepared by reacting a dimethylformamide solution of 1,1,1-trichloro-2,2,2-trifluoromethane with chlorotrimethylsilane in the presence of zinc, forming 1-(trimethylsiloxy)-2,2-dichloro-3,3,3-trifluoro-N,N-dimethylpropylamine. The 1-(trimethylsiloxy)-2,2-dichloro-3,3,3-trifluoro-N,N-dimethylpropylamine is reacted with sulfuric acid to form 2,2-dichloro-3,3,3-trifluoropropionaldehyde. The 2,2-dichloro-3,3,3-trifluoropropionaldehyde is then reacted with sulfur tetrafluoride to produce 2,2-dichloro-1,1,1,3,3-pentafluoropropane.

Until HCFC-225ba becomes available in commercial quantities, HCFC-225ba may be prepared by a standard and well-known organic synthesis technique. For example, 1,2-dichloro-1,2,3,3,3-pentafluoropropane may be prepared by the synthesis disclosed by O. Paleta et al., Bull. Soc. Chim. Fr., (6) 920–4 (1986).

Until HCFC-225bb becomes available in commercial quantities, HCFC-225bb may be prepared by a standard and well-known organic synthesis technique. For example, a synthesis of 1,2-dichloro-1,1,2,3,3-pentafluoropropane is disclosed by M. Hauptschein and L. A. Bigelow, J. Am. Chem. Soc., (73) 1428–30 (1961). The synthesis of this compound is also disclosed by A. H. Fainberg and W. T. Miller, Jr., J. Am. Chem. Soc., (79) 4170–4, (1957).

Until HCFC-225cc becomes available in commercial quantities, HCFC-225cc may be prepared by a standard and well-known organic synthesis technique. For example, 1,1-dichloro-1,2,2,3,3-pentafluoropropane may be prepared by reacting 2,2,3,3-tetrafluoro-1-propanol and p-toluenesulfonate chloride to form 2,2,3,3-tetrafluoropropyl-p-toluenesulfonate. Next, the 2,2,3,3-tetrafluoropropyl-p-toluenesulfonate is reacted with potassium fluoride in N-methylpyrrolidone to form 1,1,2,2,3-pentafluoropropane. Then, the 1,1,2,2,3-pentafluoropropane is reacted with chlorine to form 1,1-dichloro-1,2,2,3,3-pentafluoropropane.

The isomer, 1,2-dichloro-1,1,3,3,3-pentafluoropropane, is commercially available from P.C.R. Incorporated of Gainseville, Fla. Alternately, this compound may be prepared by adding equimolar amounts of 1,1,1,3,3-pentafluoropropane and chlorine gas to a borosilicate flask that has been purged of air. The flask is then irradiated with a mercury lamp. Upon completion of the irradiation, the contents of the flask are cooled. The resulting product will be 1,2-dichloro-1,1,3,3,3-pentafluoropropane.

Until HFCF-225ea becomes available in commercial quantities, HCFC-225ea may be prepared by a standard and well-known organic synthesis technique. For example, 1,3-dichloro-1,1,2,3,3-pentafluoropropane may be prepared by reacting trifluoroethylene with dichlorotrifluoromethane to produce 1,3-dichloro-1,1,2,3,3-pentafluoropropane and 1,1-dichloro-1,2,3,3,3-pentafluoropropane. The 1,3-dichloro-1,1,2,3,3-pentafluoropropane is separated from its isomers using fractional distillation and/or preparative gas chromatography.

Until HCFC-225eb becomes available in commercial quantities, HCFC-225eb may be prepared by a standard and well-known organic synthesis technique. For example, 1,1-dichloro-1,2,3,3,3-pentafluoropropane may be prepared by reacting trifluoroethylene with dichlorodifluoromethane to produce 1,3-dichloro-1,1,2,3,3-pentafluoropropane and 1,1-dichloro-1,2,3,3,3-pentafluoropropane. The 1,1-dichloro-1,2,3,3,3-pentafluoropropane is separated from its isomer using fractional distillation and/or preparative gas chromatography. Alternatively, 225eb may be prepared by a synthesis disclosed by O. Paleta et al., Bull. Soc. Chim. Fr., (6) 920–4 (1986). The 1,1-dichloro-1,2,3,3,3-pentafluoropropane can be separated from its two isomers using fractional distillation and/or preparative gas chromatography.

Preferably, the materials should be used in sufficiently high purity so as to avoid the introduction of adverse influences upon the solvency properties or constant-boiling properties of the system.

It should be understood that the present compositions may include additional components so as to form new azeotrope-like compositions. Any such compositions are considered to be within the scope of the present invention as long as the compositions are constant-boiling or essentially constant-boiling and contain all of the essential components described herein.

The present invention is more fully illustrated by the following non-limiting Examples.

EXAMPLE 1

This Example is Directed to the Preparation of 1,1-dichloro-2,2,3,3,3-pentafluoropropane

Part A—Synthesis of 2,2,3,3,3-pentafluoropropyl-p-toluenesulfonate 2,2,3,3,3-pentafluoro-1-propanol (300.8 g) was added to p-toluenesulfonate chloride(400.66 g, 2.10 mol) in water at 25° C. The mixture was heated in a 5 liter, 3-neck separatory funnel type reaction flask, under mechanical stirring, to a temperature of 50° C. Sodium hydroxide(92.56 g, 2.31 mol) in 383 ml water (6M solution) was added dropwise to the reaction mixture via addition funnel over a period of 2.5 hours, keeping the temperature below 55° C. Upon completion of this addition, when the pH of the aqueous phase was approximately 6, the organic phase was drained from the flask while still warm, and allowed to cool to 25° C. The crude product was recrystallized from petroleum ether to afford white needles of 2,2,3,3,3-pentafluoropropyl-p-toluenesulfonate (500.7 g, 1.65 mol, 82.3%).

Part B—Synthesis of 1-chloro-2,2,3,3,3-pentafluoropropane

A 1 liter flask fitted with a thermometer, Vigreaux column and distillation receiving head was charged with 248.5 g(0.82 mol) 2,2,3,3,3-pentafluoropropyl-p-toluenesulfonate(produced in Part A above), 375 ml N-methylpyrrolidone, and 46.7 g(1.1 mol) lithium chloride. The mixture was then heated with stirring to 140° C. at which point, product began to distill over. Stirring and heating were continued until a pot temperature of 198° C. had been reached at which point, there was no further distillate being collected. The crude product was re-distilled to give 107.2 g(78%) of product.

Part C—Synthesis of 1,1-dichloro-2,2,3,3,3-pentafluoropropane

Chlorine (289 ml/min) and 1-chloro-2,2,3,3,3-pentafluoropropane(produced in Part B above), (1.72 g/min) were fed simultaneously into a 1 inch(2.54 cm)×2 inches(5.08 cm) monel reactor at 300° C. The process was repeated until 184 g crude product had collected in the cold traps exiting the reactor. After washing the crude product with 6M sodium hydroxide and drying with sodium sulfate, it was distilled to give 69.2 g starting material and 46.8 g 1,1-dichloro-2,2,3,3,3-pentafluoropropane (bp 48°–50.5° C.).

$^1$H NMR: 5.9 (t, J=7.5H) ppm; $^{19}$F NMR: 79.4 (3F) and 119.8 (2F) ppm upfield from $CFCl_3$.

EXAMPLE 2

This example shows that a minimum in the boiling point versus composition curve occurs ranging from 77 to 93 weight percent HCFC-225ca and 7 to 23 weight percent cis-1,2-dichloroethylene, indicating that an azeotrope forms in the neighborhood of this composition.

The temperature of the boiling liquid mixtures was measured using ebulliometry. An ebulliometer charged with measured quantities of HCFC-225ca was used in the present example.

The ebulliometer consisted of a heated sump in which the HCFC-225ca was brought to boil. The upper part of the ebulliometer connected to the sump was cooled thereby acting as a condenser for the boiling vapors, allowing the system to operate at total reflux. After bringing the HCFC-225ca to boil at atmospheric pressure, measured amounts of cis-1,2-dichloroethylene were titrated into the ebulliometer. The change in boiling point was measured with a platinum resistance thermometer.

Table 1 shows the boiling point measurements at atmospheric pressure for various mixtures of HCFC-225ca and cis-1,2-dichloroethylene.

TABLE 1

| LIQUID MIXTURE | | |
|---|---|---|
| Weight Percentage HCFC-225ca | Weight Percentage Cis-1,2-Dichloroethylene | Boiling Point (°C.) @ 752.8 mm Hg (100 kPa) |
| 100.00 | 0.00 | 50.83 |
| 99.90 | 0.10 | 50.82 |
| 99.82 | 0.18 | 50.82 |
| 99.73 | 0.27 | 50.80 |
| 99.65 | 0.35 | 50.77 |
| 99.48 | 0.52 | 50.73 |
| 99.31 | 0.69 | 50.73 |
| 99.15 | 0.85 | 50.70 |
| 98.98 | 1.02 | 50.67 |
| 98.82 | 1.18 | 50.65 |
| 98.65 | 1.35 | 50.63 |

TABLE 1-continued

| LIQUID MIXTURE | | |
|---|---|---|
| Weight Percentage HCFC-225ca | Weight Percentage Cis-1,2-Dichloroethylene | Boiling Point (°C.) @ 752.8 mm Hg (100 kPa) |
| 98.49 | 1.51 | 50.62 |
| 98.33 | 1.67 | 50.60 |
| 98.00 | 2.00 | 50.56 |
| 97.68 | 2.32 | 50.53 |
| 97.36 | 2.64 | 50.50 |
| 97.04 | 2.96 | 50.46 |
| 96.72 | 3.28 | 50.43 |
| 95.94 | 4.06 | 50.38 |
| 95.17 | 4.83 | 50.32 |
| 94.42 | 5.58 | 50.25 |
| 93.67 | 6.33 | 50.22 |
| 92.22 | 7.78 | 50.16 |
| 89.44 | 10.56 | 50.08 |
| 86.82 | 13.18 | 50.05 |
| 84.36 | 15.64 | 50.05 |
| 82.05 | 17.95 | 50.08 |
| 79.83 | 20.17 | 50.12 |
| 77.73 | 22.27 | 50.13 |
| 74.79 | 25.21 | 50.21 |
| 71.01 | 28.99 | 50.25 |

EXAMPLE 3

Example 2 is repeated for Example 3 except that cis-1,2-dichloroethylene containing 10 weight percent trans-1,2-dichloroethylene is used. A minimum in the boiling point versus composition curve occurs indicating that a constant-boiling composition forms between HCFC-225ca and cis-1,2-dichloroethylene containing 10 weight percent trans-1,2-dichloroethylene.

EXAMPLE 4

Example 2 is repeated for Example 4 except that cis-1,2-dichloroethylene containing 5 weight percent trans-1,2-dichloroethylene is used. A minimum in the boiling point versus composition curve occurs indicating that a constant-boiling composition forms between HCFC-225ca and cis-1,2-dichloroethylene containing 5 weight percent trans-1,2-dichloroethylene.

EXAMPLE 5

Example 2 is repeated for Example 5 except that cis-1,2-dichloroethylene containing 25 weight percent trans-1,2-dichloroethylene is used. A minimum in the boiling point versus composition curve occurs indicating that a constant-boiling composition forms between HCFC-225ca and cis-1,2-dichloroethylene containing 25 weight percent trans-1,2-dichloroethylene.

EXAMPLE 6

Example 2 was repeated for Example 6 except that trans-1,2-dichloroethylene was used. This example shows that a minimum in the boiling point versus composition curve occurs ranging from 35 to 60 weight percent HCFC-225ca and 40 to 65 weight percent trans-1,2-dichloroethylene indicating that an azeotrope forms in the neighborhood of this composition.

Table 2 shows the boiling point measurements at atmospheric pressure for various mixtures of HCFC-225ca and trans-1,2-dichloroethylene.

TABLE 2

| LIQUID MIXTURE | | |
|---|---|---|
| Weight Percentage HCFC-225ca | Weight Percentage Trans-1,2-Dichloroethylene | Boiling Point (°C.) @ 744.8 mm Hg (100 kPa) |
| 0.00 | 100.00 | 46.86 |
| 11.89 | 88.11 | 45.39 |
| 21.25 | 78.75 | 44.74 |
| 25.22 | 74.78 | 44.58 |
| 26.70 | 73.30 | 44.51 |
| 28.47 | 71.53 | 44.48 |
| 31.12 | 68.88 | 44.39 |
| 33.59 | 66.41 | 44.36 |
| 35.89 | 64.11 | 44.30 |
| 38.55 | 61.45 | 44.26 |
| 40.99 | 59.01 | 44.23 |
| 43.25 | 56.75 | 44.21 |
| 45.34 | 54.66 | 44.20 |
| 47.29 | 52.71 | 44.19 |
| 49.10 | 50.90 | 44.19 |
| 50.79 | 49.21 | 44.20 |
| 52.37 | 47.63 | 44.21 |
| 55.24 | 44.76 | 44.23 |
| 57.79 | 42.21 | 44.27 |
| 60.06 | 39.94 | 44.31 |
| 62.11 | 37.89 | 44.38 |

EXAMPLE 7

Example 6 is repeated for Example 7 except that trans-1,2-dichloroethylene containing 10 weight percent cis-1,2-dichloroethylene is used. A minimum in the boiling point versus composition curve occurs indicating that a constant-boiling composition forms between HCFC-225ca and trans-1,2-dichloroethylene containing 10 weight percent cis-1,2-dichloroethylene.

EXAMPLE 8

Example 6 is repeated for Example 8 except that trans-1,2-dichloroethylene containing 5 weight percent cis-1,2-dichloroethylene is used. A minimum in the boiling point versus composition curve occurs indicating that a constant-boiling composition forms between HCFC-225ca and trans-1,2-dichloroethylene containing 5 weight percent cis-1,2-dichloroethylene.

EXAMPLE 9

Example 6 is repeated for Example 9 except that trans-1,2-dichloroethylene containing 25 weight percent cis-1,2-dichloroethylene is used. A minimum in the boiling point versus composition curve occurs indicating that a constant-boiling composition forms between HCFC-225ca and trans-1,2-dichloroethylene containing 25 weight percent cis-1,2-dichloroethylene.

EXAMPLES 10–18

The azeotropic properties of the dichloropentafluoropropane components listed in Table 3 with cis-1,2-dichloroethylene are studied by repeating the experiment outlined in Example 2 above. In each case, a minimum in the boiling point versus composition curve occurs indicating that a constant-boiling composition forms between the dichloropentafluoropropane component and cis-1,2-dichloroethylene.

TABLE 3

2,2-dichloro-1,1,1,3,3-pentafluoropropane (HCFC-225a)

1,2-dichloro-1,2,3,3,3-pentafluoropropane (HCFC-225ba)

1,2-dichloro-1,1,2,3,3-pentafluoropropane (HCFC-225bb)
1,1-dichloro-1,2,2,3,3-pentafluoropropane (HCFC-225cc)
1,2-dichloro-1,1,3,3,3-pentafluoropropane (HCFC-225d)
1,3-dichloro-1,1,2,3,3-pentafluoropropane (HCFC-225ea)
1,1-dichloro-1,2,3,3,3-pentafluoropropane (HCFC-225eb)
1,1-dichloro-2,2,3,3,3-pentafluoropropane/1,3-dichloro-1,1,2,2,3-pentafluoropropane (mixture of HCFC-225ca and HCFC-225cb)
1,1-dichloro-1,2,3,3,3-pentafluoropropane/1,3-dichloro-1,1,2,2,3-pentafluoropropane (mixture of HCFC-225eb and HCFC-225cb)

EXAMPLES 19-27

The azeotropic properties of the dichloropentafluoropropane components listed in Table 3 with cis-1,2-dichloroethylene containing 5 weight percent trans-1,2-dichloroethylene are studied by repeating the experiment outlined in Example 2 above. In each case, a minimum in the boiling point versus composition curve occurs indicating that a constant-boiling composition forms between the dichloropentafluoropropane component and cis-1,2-dichloroethylene containing 5 weight percent trans-1,2-dichloroethylene.

EXAMPLES 28-36

The azeotropic properties of the dichloropentafluoropropane components listed in Table 3 with cis-1,2-dichloroethylene containing 10 weight percent trans-1,2-dichloroethylene are studied by repeating the experiment outlined in Example 2 above. In each case, a minimum in the boiling point versus composition curve occurs indicating that a constant-boiling composition forms between the dichloropentafluoropropane component and cis-1,2-dichloroethylene containing 10 weight percent trans-1,2-dichloroethylene.

EXAMPLES 37-45

The azeotropic properties of the dichloropentafluoropropane components listed in Table 3 with cis-1,2-dichloroethylene containing 25 weight percent trans-1,2-dichloroethylene are studied by repeating the experiment outlined in Example 2 above. In each case, a minimum in the boiling point versus composition curve occurs indicating that a constant-boiling composition forms between the dichloropentafluoropropane component and cis-1,2-dichloroethylene containing 25 weight percent trans-1,2-dichloroethylene.

EXAMPLE 46

This example is directed to the preparation of 1,3-dichloro-1,1,2,2,3-pentafluoropropane.

Part A—Synthesis of 2,2,3,3-tetrafluoropropyl-p-toluenesulfonate 2,2,3,3-tetrafluoropropanol(406 g, 3.08 mol), 613 g tosyl chloride(3.22 mol), and 1200 ml water heated to 50° C. with mechanical stirring. Sodium hydroxide(139.7 g, 3.5 ml) in 560 ml water was added at a rate such that the temperature remained less than 65° C. After the addition was completed, the mixture was stirred at 50° C. until the pH of the aqueous phase was 6. The mixture was cooled and extracted with 1.5 liters methylene chloride. The organic layer was washed twice with 200 ml aqueous ammonia, 350 ml water, dried with magnesium sulfate, and distilled to give 697.2 g(79%) viscous oil.

Part B—Synthesis of 1,1,2,2,3-pentafluoropropane

A 500 ml flask was equipped with a mechanical stirrer and a Vigreaux distillation column, which in turn was connected to a dry-ice trap, and maintained under a nitrogen atmosphere. The flask was charged with 400 ml N-methylpyrrolidone, 145 g(0.507 mol) 2,2,3,3-tetrafluoropropyl p-toluenesulfonate(produced in Part A above), and 87 g(1.5 mol) spray-dried KF. The mixture was then heated to 190°-200° C. for about 3.25 hours during which time 61 g volatile product distilled into the cold trap(90% crude yield). Upon distillation, the fraction boiling at 25°-28° C. was collected.

Part C—Synthesis of 1,1,3-trichloro-1,2,2,3,2-pentafluoropropane

A 22 liter flask was evacuated and charged with 20.7 g(0.154 mol) 1,1,2,2,3-pentafluoropropane(produced in Part B above) and 0.6 mol chlorine. It was irradiated 100 minutes with a 450 W Hanovia Hg lamp at a distance of about 3 inches(7.6 cm). The flask was then cooled in an ice bath, nitrogen being added as necessary to maintain 1 atm (101 kPa). Liquid in the flask was removed via syringe. The flask was connected to a dry-ice trap and evacuated slowly(15-30 minutes). The contents of the dry-ice trap and the initial liquid phase totaled 31.2 g(85%), the GC purity being 99.7%. The product from several runs was combined and distilled to provide a material having b.p. 73.5°-74° C.

Part D—Synthesis of 1,3-dichloro-1,1,2,2,3-pentafluoropropane 1,1,3-trichloro-1,2,2,3,3-pentafluoropropane(produced in Part C above) (106.6 g, 0.45 mol) and 300 g(5 mol) isopropanol were stirred under an inert atmosphere and irradiated 4.5 hours with a 450 W Hanovia Hg lamp at a distance of 2-3 inches(5-7.6 cm). The acidic reaction mixture was then poured into 1.5 liters ice water. The organic layer was separated, washed twice with 50 ml water, dried with calcium sulfate, and distilled to give 50.5 g $ClCF_2CF_2CHClF$, bp 54.5°-56° C. (55%). $^1H$ NMR ($CDCl_3$): ddd centered at 6.43 ppm. J H—C—F=47 Hz, J H—C—C—Fa=12 Hz, J H—C—C—Fb=2 Hz.

EXAMPLE 47

This example shows that a minimum in the boiling point versus composition curve occurs ranging from 62 to 82 weight percent HCFC-225 cb and 18 to 38 weight percent cis-1,2-dichloroethylene, indicating that an azeotrope forms in the neighborhood of this composition.

The temperature of the boiling liquid mixtures was measured using ebulliometry. An ebulliometer charged with measured quantities of HCFC-225 cb was used in the present example.

The ebulliometer consisted of a heated sump in which the HCFC-225 cb was brought to boil. The upper part of the ebulliometer connected to the sump was cooled thereby acting as a condenser for the boiling vapors, allowing the system to operate at total reflux. After bringing the HCFC-225 cb to boil at atmospheric pressure, measured amounts of cis-1,2-dichloroethylene were titrated into the ebulliometer. The change in boiling point was measured with a platinum resistance thermometer.

Table 4 shows the boiling point measurements at atmospheric pressure for various mixtures of HCFC-225 cb and cis-1,2-dichloroethylene.

TABLE 4

| LIQUID MIXTURE | | |
|---|---|---|
| Weight Percentage HCFC-225cb | Weight Percentage Cis-1,2-Dichloroethylene | Boiling Point (°C.) @ 751.4 mm Hg (100 kPa) |
| 100.00 | 0.00 | 55.73 |
| 99.92 | 0.08 | 55.69 |
| 99.75 | 0.25 | 55.61 |
| 99.34 | 0.66 | 55.53 |
| 97.72 | 2.28 | 55.19 |
| 94.64 | 5.36 | 54.70 |
| 91.75 | 8.25 | 54.32 |
| 89.63 | 10.97 | 54.05 |
| 86.47 | 13.53 | 53.85 |
| 84.05 | 15.95 | 53.73 |
| 81.76 | 18.24 | 53.63 |
| 79.60 | 20.40 | 53.58 |
| 77.54 | 22.46 | 53.53 |
| 75.59 | 24.41 | 53.51 |
| 73.74 | 26.26 | 53.52 |
| 71.97 | 28.03 | 53.51 |
| 70.29 | 29.71 | 53.52 |
| 68.68 | 31.32 | 53.53 |
| 67.15 | 32.85 | 53.55 |
| 65.32 | 34.68 | 53.55 |
| 63.59 | 36.41 | 53.59 |
| 61.95 | 38.05 | 53.62 |
| 60.09 | 39.91 | 53.65 |
| 58.34 | 41.66 | 53.68 |
| 56.69 | 43.31 | 53.71 |

EXAMPLE 48

Example 47 is repeated for Example 48 except that cis-1,2-dichloroethylene containing 10 weight percent trans-1,2-dichloroethylene is used. A minimum in the boiling point versus composition curve occurs indicating that a constant-boiling composition forms between HCFC-225cb and cis-1,2-dichloroethylene containing 10 weight percent trans-1,2-dichloroethylene.

EXAMPLE 49

Example 47 is repeated for Example 49 except that cis-1,2-dichloroethylene containing 5 weight percent trans-1,2-dichloroethylene is used. A minimum in the boiling point versus composition curve occurs indicating that a constant-boiling composition forms between HCFC-225cb and cis-1,2-dichloroethylene containing 5 weight percent trans-1,2-dichloroethylene.

EXAMPLE 50

Example 47 is repeated for Example 50 except that cis-1,2-dichloroethylene containing 25 weight percent trans-1,2-dichloroethylene is used. A minimum in the boiling point versus composition curve occurs indicating that a constant-boiling composition forms between HCFC-225cb and cis-1,2-dichloroethylene containing 25 weight percent trans-1,2-dichloroethylene.

EXAMPLE 51

Example 47 was repeated for Example 51 except that trans-1,2-dichloroethylene was used. This example shows that a minimum in the boiling point versus composition curve occurs ranging from 23 to 49 weight percent HCFC-225cb and 51 to 77 weight percent trans-1,2-dichloroethylene indicating that an azeotrope forms in the neighborhood of this composition.

Table 5 shows the boiling point measurements at atmospheric pressure for various mixtures of HCFC-225cb and trans-1,2-dichloroethylene.

TABLE 5

| LIQUID MIXTURE | | |
|---|---|---|
| Weight Percentage HCFC-225cb | Weight Percentage Trans-1,2-Dichloroethylene | Boiling Point (°C.) @ 743.3 mm Hg (99 kPa) |
| 0.00 | 100.00 | 46.89 |
| 13.30 | 86.70 | 45.82 |
| 23.48 | 76.52 | 45.58 |
| 31.52 | 68.48 | 45.48 |
| 38.03 | 61.97 | 45.48 |
| 39.19 | 60.81 | 45.50 |
| 40.30 | 59.70 | 45.51 |
| 41.38 | 48.62 | 45.52 |
| 43.41 | 56.59 | 45.54 |
| 45.31 | 54.69 | 45.57 |
| 47.09 | 52.91 | 45.54 |
| 48.75 | 51.25 | 45.58 |
| 50.32 | 49.68 | 45.59 |
| 51.79 | 48.21 | 45.63 |

EXAMPLE 52

Example 51 is repeated for Example 52 except that trans-1,2-dichloroethylene containing 10 weight percent cis-1,2-dichloroethylene is used. A minimum in the boiling point versus composition curve occurs indicating that a constant-boiling composition forms between HCFC-225cb and trans-1,2-dichloroethylene containing 10 weight percent cis-1,2-dichloroethylene.

EXAMPLE 53

Example 51 is repeated for Example 53 except that trans-1,2-dichloroethylene containing 5 weight percent cis-1,2-dichloroethylene is used. A minimum in the boiling point versus composition curve occurs indicating that a constant-boiling composition forms between HCFC-225cb and trans-1,2-dichloroethylene containing 5 weight percent cis-1,2-dichloroethylene.

EXAMPLE 54

Example 51 is repeated for Example 54 except that trans-1,2-dichloroethylene containing 25 weight percent cis-1,2-dichloroethylene is used. A minimum in the boiling point versus composition curve occurs indicating that a constant-boiling composition forms between HCFC-225cb and trans-1,2-dichloroethylene containing 25 weight percent cis-1,2-dichloroethylene.

EXAMPLES 55–63

The azeotropic properties of the dichloropentafluoropropane components listed in Table 3 above with trans-1,2-dichloroethylene are studied by repeating the experiment outlined in Example 51 above. In each case, a minimum in the boiling point versus composition curve occurs indicating that a constant-boiling composition forms between the dichloropentafluoropropane component and trans-1,2-dichloroethylene.

EXAMPLES 64–72

The azeotropic properties of the dichloropentafluoropropane components listed in Table 3 with trans-1,2-dichloroethylene containing 5 weight percent cis-1,2-dichloroethylene are studied by repeating the experiment outlined in Example 51 above. In each case, a minimum in the boiling point versus composition curve occurs indicating that a constant-boiling composition forms between the dichloropentafluoropropane component and trans-1,2-dichloroethylene containing 5 weight percent cis-1,2-dichloroethylene.

EXAMPLES 73-81

The azeotropic properties of the dichloropentafluoropropane components listed in Table 3 with trans-1,2-dichloroethylene containing 10 weight percent cis-1,2-dichloroethylene are studied by repeating the experiment outlined in Example 51 above. In each case, a minimum in the boiling point versus composition curve occurs indicating that a constant-boiling composition forms between the dichloropentafluoropropane component and trans-1,2-dichloroethylene containing 10 weight percent cis-1,2-dichloroethylene.

EXAMPLES 82-90

The azeotropic properties of the dichloropentafluoropropane components listed in Table 3 with trans-1,2-dichloroethylene containing 25 weight percent cis-1,2-dichloroethylene are studied by repeating the experiment outlined in Example 51 above. In each case, a minimum in the boiling point versus composition curve occurs indicating that a constant-boiling composition forms between the dichloropentafluoropropane component and trans-1,2-dichloroethylene containing 25 weight percent cis-1,2-dichloroethylene.

Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: epoxy compounds such as propylene oxide; nitroalkanes such as nitromethane; ethers such as 1-4-dioxane; unsaturated compounds such as 1,4-butyne diol; acetals or ketals such as dipropoxy methane; ketones such as methyl ethyl ketone; alcohols such as tertiary amyl alcohol; esters such as triphenyl phosphite; and amines such as triethyl amine. Other suitable inhibitors will readily occur to those skilled in the art.

Having described the invention in detail and by reference to preferred embodiments thereof, it will be apparent that modifications and variations are possible without departing from the scope of the invention defined in the appended claims.

What is claimed is:

1. Azeotrope-like compositions consisting essentially of from about 77 to about 93 weight percent 1,1-dichloro-2,2,3,3,3-pentafluoropropane and from about 7 to about 23 weight percent cis-1,2-dichloroethylene which boil at about 50.0° C. at 753 mm Hg; or from about 77 to about 93 weight percent 1,1-dichloro-2,2,3,3,3-pentafluoropropane and from about 7 to about 23 weight percent of a mixture consisting of cis-1,2-dichloroethylene and trans-1,2-dichloroethylene wherein said trans-1,2-dichloroethylene is present in an amount of from about 0.1 to about 25 weight percent of said mixture which boil at about 50.0° C. at 753 mm Hg; or from about 62 to about 82 weight percent 1,3-dichloro-1,1,2,2,3-pentafluoropropane and from about 18 to about 38 weight percent cis-1,2-dichloroethylene which boil at about 53.5° C. at 751 mm Hg; or from about 62 to about 82 weight percent 1,3-dichloro-1,1,2,2,3-pentafluoropropane and from about 18 to about 38 weight percent of a mixture consisting of cis-1,2-dichloroethylene and trans-1,2-dichloroethylene wherein said trans-1,2-dichloroethylene is present in an amount of from about 0.1 to about 25 weight percent of said mixture which boil at about 53.5° C. at 751 mm Hg; or from about 35 to about 60 weight percent 1,1-dichloro-2,2,3,3,3-pentafluoropropane and from about 40 to about 65 weight percent trans-1,2-dichloroethylene which boil at about 44.2° C. at 745 mm Hg; or from about 35 to about 60 weight percent 1,1-dichloro-2,2,3,3,3-pentafluoropropane and from about 40 to about 65 weight percent of a mixture consisting of cis-1,2-dichloroethylene and trans-1,2-dichloroethylene wherein said cis-1,2-dichloroethylene is present in an amount of from about 0.1 to about 25 weight percent of said mixture which boil at about 44.2° C. at 745 mm Hg; or from about 23 to about 49 weight percent 1,3-dichloro-1,1,2,2,3-pentafluoropropane and from about 51 to about 77 weight percent trans-1,2-dichloroethylene which boil at about 45.5° C. at 743 mm Hg; or from about 23 to about 49 weight percent 1,3-dichloro-1,1,2,2,3-pentafluoropropane and from about 51 to about 77 weight percent of a mixture consisting of trans-1,2-dichloroethylene and cis-1,2-dichloroethylene wherein said cis-1,2-dichloroethylene is present in an amount of from about 0.1 to about 25 weight percent of said mixture which boil at about 45.5° C. at 743 mm Hg; wherein the components of each azeotrope-like composition consist of 1,1-dichloro-2,2,3,3,3-pentafluoropropane or 1,3-dichloro-1,1,2,2,3-pentafluoropropane and cis-1,2-dichloroethylene, trans-1,2-dichloroethylene or a mixture of cis-1,2-dichloroethylene and trans-1,2-dichloroethylene.

2. The azeotrope-like compositions of claim 1 consisting essentially of from about 80 to about 92 weight percent said 1,1-dichloro-2,2,3,3,3-pentafluoropropane and from about 8 to about 20 weight percent said cis-1,2-dichloroethylene.

3. The azeotrope-like compositions of claim 2 consisting essentially of from about 80 to about 91 weight percent said 1,1-dichloro-2,2,3,3,3-pentafluoropropane and from about 9 to about 20 weight percent said cis-1,2-dichloroethylene.

4. The azeotrope-like compositions of claim 1 consisting essentially of from about 64 to about 80 weight percent said 1,3-dichloro-1,1,2,2,3-pentafluoropropane and from about 20 to about 36 weight percent said cis-1,2-dichloroethylene.

5. The azeotrope-like compositions of claim 4 consisting essentially of from about 66 to about 80 weight percent said 1,3-dichloro-1,1,2,2,3-pentafluoropropane and from about 20 to about 34 weight percent said cis-1,2-dichloroethylene.

6. The azeotrope-like compositions of claim 1 consisting essentially of from about 38 to about 56 weight percent said 1,1-dichloro-2,2,3,3,3-pentafluoropropane and from about 44 to about 62 weight percent said trans-1,2-dichloroethylene.

7. The azeotrope-like compositions of claim 1 consisting essentially of from about 25 to about 44 weight percent said 1,3-dichloro-1,1,2,2,3-pentafluoropropane and from about 56 to about 75 weight percent said trans-1,2-dichloroethylene.

8. Azeotrope-like compositions consisting essentially of from about 77 to about 93 weight percent 1,1-dichloro-2,2,3,3,3-pentafluoropropane and from about 7 to about 23 weight percent of a mixture consisting of cis-1,2-dichloroethylene and trans-1,2-dichloroethylene wherein said trans-1,2-dichloroethylene is present in an amount of from about 0.1 to about 10 weight percent of said mixture which boil at about 50.0° C. at 753 mm Hg.

9. The azeotrope-like compositions of claim 8 wherein said compositions consist essentially of from about 77 to about 93 weight percent 1,1-dichloro-2,2,3,3,3-pentafluoropropane and from about 7 to about 23 weight percent of a mixture consisting of cis-1,2-dichloroethylene and trans-1,2-dichloroethylene wherein said trans-1,2-dichloroethylene is present in an amount of from about 0.1 to about 5 weight percent of said mixture.

10. Azeotrope-like compositions consisting essentially of from about 62 to about 82 weight percent 1,3-dichloro-1,1,2,2,3-pentafluoropropane and from about 18 to about 38 weight percent of a mixture consisting of cis-1,2-dichloroethylene and trans-1,2-dichloroethylene wherein said trans-1,2-dichloroethylene is present in an amount of from about 0.1 to about 10 weight percent of said mixture which boil at about 53.5° C. at 751 mm Hg.

11. The azeotrope-like compositions of claim 10 wherein said compositions consist essentially of from about 62 to about 82 weight percent 1,3-dichloro-1,1,2,2,3-pentafluoropropane and from about 18 to about 38 weight percent of a mixture consisting of cis-1,2-dichloroethylene and trans-1,2-dichloroethylene wherein said trans-1,2-dichloroethylene is present in an amount of from about 0.1 to about 5 weight percent of said mixture.

12. Azeotrope-like compositions consisting essentially of from about 35 to about 60 weight percent 1,1-dichloro-2,2,3,3,3-pentafluoropropane and from about 40 to about 65 weight percent of a mixture consisting of trans-1,2-dichloroethylene and cis-1,2-dichloroethylene wherein said cis-1,2-dichloroethylene is present in an amount of from about 0.1 to about 10 weight percent of said mixture which boil at about 44.2° C. at 745 mm Hg.

13. The azeotrope-like compositions of claim 12 wherein said compositions consist essentially of from about 35 to about 60 weight percent 1,1-dichloro-2,2,3,3,3-pentafluoropropane and from about 40 to about 65 weight percent of a mixture consisting of trans-1,2-dichloroethylene and cis-1,2-dichloroethylene wherein said cis-1,2-dichloroethylene is present in an amount of from about 0.1 to about 5 weight percent of said mixture.

14. Azeotrope-like compositions consisting essentially of from about 23 to about 49 weight percent 1,3-dichloro-1,1,2,2,3-pentafluoropropane and from about 51 to about 77 weight percent of a mixture consisting of trans-1,2-dichloroethylene and cis-1,2-dichloroethylene wherein said cis-1,2-dichloroethylene is present in an amount of from about 0.1 to about 10 weight percent of said mixture which boil at about 45.5° C. at 743 mm Hg.

15. The azeotrope-like compositions of claim 14 wherein said compositions consist essentially of from about 23 to about 49 weight percent 1,3-dichloro-1,1,2,2,3-pentafluoropropane and from about 51 to about 77 weight percent of a mixture consisting of trans-1,2-dichloroethylene and cis-1,2-dichloroethylene wherein said cis-1,2-dichloroethylene is present in an amount of from about 0.1 to about 5 weight percent of said mixture.

16. The azeotrope-like compositions of claim 8 wherein said compositions boil at 50.0° C. ± about 0.5° C. at 753 mm Hg.

17. The azeotrope-like compositions of claim 10 wherein said compositions boil at 53.5° C. ± about 0.5° C. at 751 mm Hg.

18. The azeotrope-like compositions of claim 12 wherein said compositions boil at 44.2° C. ± about 0.5° C. at 745 mm Hg.

19. The azeotrope-like compositions of claim 14 wherein said compositions boil at 45.5° C. ± about 0.5° C. at 743 mm Hg.

20. The azeotrope-like compositions of claim 1 wherein said compositions of 1,1-dichloro-2,2,3,3,3-pentafluoropropane and cis-1,2-dichloroethylene boil at 50.0° C. ± about 0.5° C. at 753 mm Hg.

21. The azeotrope-like compositions of claim 1 wherein said compositions of 1,1-dichloro-2,2,3,3,3-pentafluoropropane and a mixture of cis-1,2-dichloroethylene and trans-1,2-dichloroethylene wherein said trans-1,2-dichloroethylene is present in an amount of from about 0.1 to about 25 weight percent of said mixture boil at 50.0° C. ± about 0.5° C. at 753 mm Hg.

22. The azeotrope-like compositions of claim 1 wherein said compositions of 1,3-dichloro-1,1,2,2,3-pentafluoropropane and cis-1,2-dichloroethylene boil at 53.5° C. ± about 0.5° C. at 751 mm Hg.

23. The azeotrope-like compositions of claim 1 wherein said compositions of 1,3-dichloro-1,1,2,2,3-pentafluoropropane and a mixture of cis-1,2-dichloroethylene and trans-1,2-dichloroethylene wherein said trans-1,2-dichloroethylene is present in an amount from about 0.1 to about 25 weight percent of said mixture boil at 53.5° C. ± about 0.5° C. at 751 mm Hg.

24. The azeotrope-like compositions of claim 1 wherein said compositions of 1,1-dichloro-2,2,3,3,3-pentafluoropropane and trans-1,2-dichloroethylene boil at 44.2° C. ± about 0.5° C. at 745 mm Hg.

25. The azeotrope-like compositions of claim 1 wherein said compositions of 1,1-dichloro-2,2,3,3,3-pentafluoropropane and a mixture of cis-1,2-dichloroethylene and trans-1,2-dichloroethylene wherein said cis-1,2-dichloroethylene is present in an amount of from about 0.1 to about 25 weight percent of said mixture boil at 44.2° C. ± about 0.5° C. at 745 mm Hg.

26. The azeotrope-like compositions of claim 1 wherein said compositions of 1,3-dichloro-1,1,2,2,3-pentafluoropropane and trans-1,2-dichloroethylene boil at 45.5° C. ± about 0.5° C. at 743 mm Hg.

27. The azeotrope-like compositions of claim 1 wherein said compositions of 1,3-dichloro-1,1,2,2,3-pentafluoropropane and a mixture of cis-1,2-dichloroethylene and trans-1,2-dichloroethylene wherein said cis-1,2-dichloroethylene is present in an amount of from about 0.1 to about 25 weight percent of said mixture boil at 45.5° C. ± about 0.5° C. at 743 mm Hg.

28. The azeotrope-like compositions of claim 1 wherein an effective amount of an inhibitor is present in said compositions to accomplish at least one of the following: to inhibit decomposition of the compositions; react with undesirable decomposition products of the compositions and prevent corrosion of metal surfaces.

29. The azeotrope-like compositions of claim 2 wherein an effective amount of an inhibitor is present in said compositions to accomplish at least one of the following: to inhibit decomposition of the compositions; react with undesirable decomposition products of the compositions and prevent corrosion of metal surfaces.

30. The azeotrope-like compositions of claim 28 wherein said inhibitor is selected from the group consisting of epoxy compounds, nitroalkanes, acetals, ketals, ketones, alcohols, esters, and amines.

31. The azeotrope-like compositions of claim 29 wherein said inhibitor is selected from the group consisting of epoxy compounds, nitroalkanes, acetals, ketals, ketones, alcohols, esters, and amines.

32. The azeotrope-like composition of claim 4 wherein an effective amount of an inhibitor is present in said compositions to accomplish at least one of the following: to inhibit decomposition of the compositions; react with undesirable decomposition products of the compositions and prevent corrosion of metal surfaces.

33. The azeotrope-like compositions of claim 32 wherein said inhibitor is selected from the group consisting of epoxy compounds, nitroalkanes, acetals, ketals, ketones, alcohols, esters, and amines.

34. The azeotrope-like compositions of claim 6 wherein an effective amount of an inhibitor is present in to accomplish at least one of the following: to inhibit decomposition of the compositions; react with undesirable decomposition products of the compositions and prevent corrosion of metal surfaces consisting of epoxy compounds, nitroalkanes, acetals, ketals, ketones, alcohols, esters, and amines.

35. The azeotrope-like compositions of claim 34 wherein said inhibitor is selected from the group consisting of epoxy compounds, nitroalkanes, acetals, ketals, ketones, alcohols, esters, and amines, to accomplish at least one of the following: to inhibit decomposition of the compositions; react with undesirable decomposition products of the compositions and prevent corrosion of metal surfaces.

36. The azeotrope-like compositions of claim 7 wherein an effective amount of an inhibitor is present in said compositions to accomplish at least one of the following: to inhibit decomposition of the compositions; react with undesirable decomposition products of the compositions and prevent corrosion of metal surfaces.

37. The azeotrope-like compositions of claim 36 wherein said inhibitor is selected from the group consisting of epoxy compounds, nitroalkanes, acetals, ketals, ketones, alcohols, esters, and amines.

38. A method of cleaning a solid surface which comprises treating said surface with said azeotrope-like composition as defined in claim 1.

39. A method of cleaning a solid surface which comprises treating said surface with said azeotrope-like composition as defined in claim 2.

40. A method of cleaning a solid surface which comprises treating said surface with said azeotrope-like composition as defined in claim 4.

41. A method of cleaning a solid surface which comprises treating said surface with said azeotrope-like composition as defined in claim 6.

42. A method of cleaning a solid surface which comprises treating said surface with said azeotrope-like composition as defined in claim 7.

* * * * *